United States Patent [19]

Grenier

[11] Patent Number: 5,000,301

[45] Date of Patent: Mar. 19, 1991

[54] SUITCASE

[75] Inventor: Jean Grenier, Pantin, France

[73] Assignee: 501 Louis Vuitton Malletier, Paris, France

[21] Appl. No.: 5,369

[22] Filed: Jan. 13, 1987

Related U.S. Application Data

[63] Continuation of Ser. No. 792,161, Oct. 24, 1985, which is a continuation of Ser. No. 531,901, Sep. 12, 1983.

[30] Foreign Application Priority Data

Sep. 14, 1982 [FR] France ..... 82 15483

[51] Int. Cl.[5] ..... A45C 13/36

[52] U.S. Cl. ..... 190/127; 190/107; 190/124; 190/25

[58] Field of Search ..... 220/4 F; 190/24, 25, 190/40, 107, 122, 124, 125, 126, 127; 206/453, 523, 526, 587, 512; 52/255, 288

[56] References Cited

U.S. PATENT DOCUMENTS

| | | | |
|---|---|---|---|
| 131,258 | 9/1872 | Evarts | 190/24 |
| 466,966 | 1/1892 | Roemer | 190/126 |
| 1,139,726 | 5/1915 | Roberts | 190/24 |
| 1,496,981 | 6/1924 | Dresner | 190/124 |
| 1,556,280 | 10/1925 | Berg . | |
| 1,605,823 | 11/1926 | Elliott | 190/127 |
| 1,908,671 | 5/1933 | Hossfeld | 190/124 |
| 1,985,521 | 12/1934 | Schell | 190/124 |
| 2,182,604 | 12/1939 | Wheary | 190/124 |
| 3,352,389 | 11/1967 | Chubb | 190/125 |
| 3,363,730 | 1/1968 | Guss | 190/125 |
| 3,730,309 | 5/1973 | Hamann et al. | 190/127 |
| 3,836,043 | 9/1974 | Levin | 206/512 |
| 3,955,702 | 5/1976 | Lundy | 220/4 F |
| 3,989,157 | 11/1976 | Voenema | 220/4 F |
| 4,161,853 | 7/1979 | Weiss et al. | 52/288 |
| 4,430,833 | 2/1984 | Balzer et al. | 52/255 |
| 4,505,402 | 3/1985 | Gerhard | 220/4 F |
| 4,558,797 | 12/1985 | Mitchell | 220/4 F |

FOREIGN PATENT DOCUMENTS

| | | | |
|---|---|---|---|
| 2758392 | 7/1979 | Fed. Rep. of Germany | 190/124 |
| 423785 | 4/1911 | France . | |
| 1263234 | 5/1961 | France . | |
| 83105 | 5/1964 | France . | |
| 1544543 | 9/1968 | France . | |
| 242448 | 11/1925 | United Kingdom | 190/40 |

*Primary Examiner*—David T. Fidei

*Attorney, Agent, or Firm*—Merchant, Gould, Smith, Edell, Welter & Schmidt

[57] ABSTRACT

In the suitcase according to this invention each of its two parts (container or cover) is formed from a dismountable belt with four panels and from a bottom connected at the four corners through four structural connection parts, each of the latter comprising known assembling and/or fitting in elements or means for the edge portions of two adjacent panels and for the corresponding angle of the bottom to be connected so as to form a rectangular trihedron used as means for supporting, mounting and securing a protective corner, on the one hand, and on the other hand, reinforcing corner irons protecting from shocks in the longitudinal, vertical and transverse directions, each corner iron clamping the selvedge of a suitcase coating material against the corresponding panel.

8 Claims, 2 Drawing Sheets

SUITCASE

This is a continuation of application Ser. No. 792,161, filed 24 Oct. 1985 which is a continuation of application Ser. No. 531,901, filed Sept. 12, 1983.

TECHNICAL FIELD

This invention relates to an improved shock and deformation stress resistant suitcase.

BACKGROUND OF THE INVENTION

The most known suitcases for resisting shocks and various deformation stresses generally consist of one-piece parts with the one forming the bottom or container of the suitcase and the other being the cover. Each of said parts is made of a specially resistant material such as metal or plastics material and it is formed by any appropriate process such as stamping, casting, moulding and the like processes. They are assembled thereafter through hinges subsequently mounted thereon or introduced in the forming step. Other accessories such as locks, handles and the like are also provided and mounted thereon in the appropriate manufacturing step. Although such type of suitcase is efficient in several respects, in particular, because they are shock resistant, in case of deficiency therein or incidents or accidents damaging the suitcase structure itself, the suitcase cannot in most cases be easily repaired or it is generally little economical to repair it precisely because of the monolithic nature of its main components. The user therefore usually decides to change or replace a deficient suitcase to avoid losing time and money repairing it assuming that this is possible.

Furthermore, such suitcases are little aesthetic and their design does not always permit to apply a coating thereon such as tissue, skin, leather and the like. However, assuming that such coating or an external original presentation thereof should be possible, the means used for this purpose would be subject to quick deterioration since they could only be added thereto thereby either becoming easily deformable or being accidentally torn off or damaged by shocks, compressions or frictions, in multiple handlings or manipulations to which such suitcases are submitted in travelling especially when they are taken up for transportation in railway cars, boots, containers, baggage rooms, holds and the like. Although suitcases are known, having a resistant structure of aesthetic aspect comprising a coating thereon suited to the user's tastes, both the structure thereof and means used for reinforcing them so as to increase shock resistance such as for example metallic corner protecting means fitted thereto or glues, rivets, and the like, for adhering or securing coatings are not protected from degradation, deterioration, tearing off, and the like.

The object of this invention is therefore to provide an improved suitcase which due to its structure can resist shocks and various deformation stresses, on the one hand, and on the other hand, may be rendered aesthetic through any desired coating applied thereon without having recourse to any damageable securement or mounting accessories, with the main components of the suitcase being removable and exchangeable.

SUMMARY OF THE INVENTION

Therefore, the suitcase according to this invention, comprising its two parts, container and cover, assembled through hinge means is substantially characterized in that each of said two parts is constituted by a removable belt with four panels and a bottom connected at each of the four corners through four structural connection pieces, each comprising assembling and/or fitting in elements or means, for the edge portions of two adjacent panels, and the corresponding bottom angle, to be connected so as to form a rectangular trihedron serving as means for supporting, mounting and securing a protective corner, on the one hand, and on the other hand, reinforcing corner irons protecting from shocks in the longitudinal, vertical and transverse direction, with each of the corner irons clamping the selvedge of a suitcase coating material against the corresponding panel.

According to other characteristics:

the elements or means for assembling and/or fitting in as provided for the connection parts and the intermediary structural parts are of any known type such as those including dovetailing, mortise and tenon joints, simple angle straddlers, and the like;

the panels and the bottom of the respective portion (cover or container) of the suitcase are made in any suitable material such as metal, wood, plastics material, chipboards, material of reinforced fibers, composite materials and the like, and may be easily changed;

the coating material is of any suitable type, such as natural or synthetic tissue, paper, plastics material sheet, leather, skin, and the like.

BRIEF DESCRIPTION OF THE DRAWINGS

Other characteristics and advantages of this invention will more clearly appear from the following description, which is made with reference to the attached drawings in which.

DETAILED DESCRIPTION OF THE PREFERRED EMBODIMENT

Figure 1:
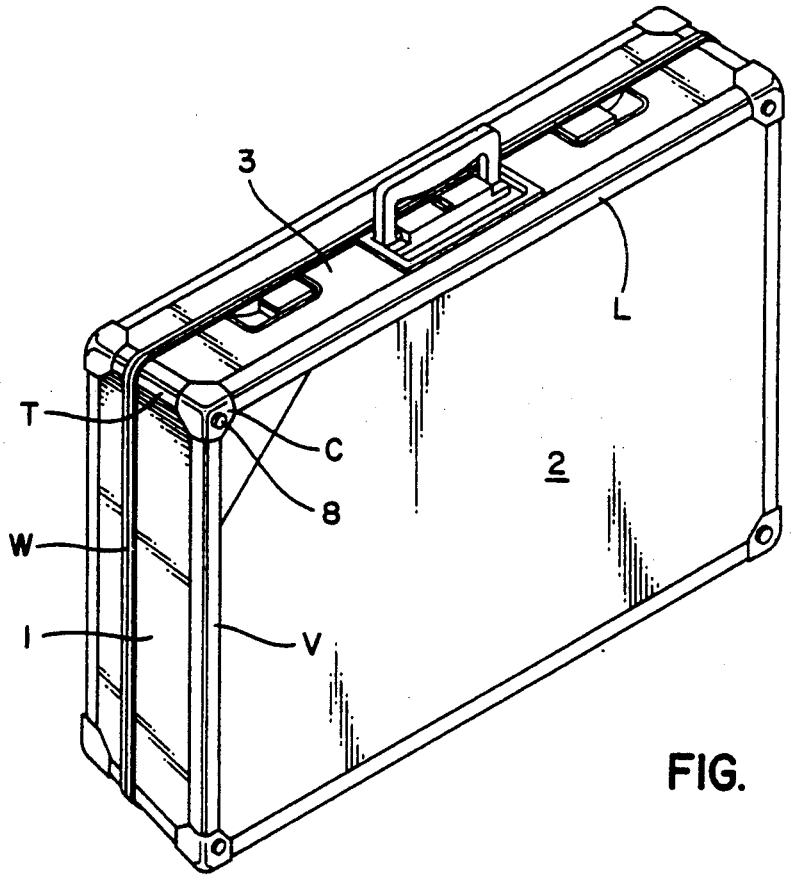
FIG. 1 is a perspective schematic view of a suitcase according to this invention.

With reference to the drawings, it clearly appears from FIG. 1 showing a suitcase according to the invention that the edge portions thereof are reinforced by protective and reinforcing parts designated by reference numerals L, V, T, C and W, respectively, and which are designed realized and mounted in such manner (as will be seen hereinafter) that the suitcase resists deformation stresses and shocks. Furthermore, since they are entirely dismountable the elements that could be damaged can be easily replaced. Additionally, the design of the mounting assembly is such as to permit to coat as desired the six panels thereof. The three panels that can be seen in the drawings are designated by reference numerals 1, 2 and 3.

Figure 2:
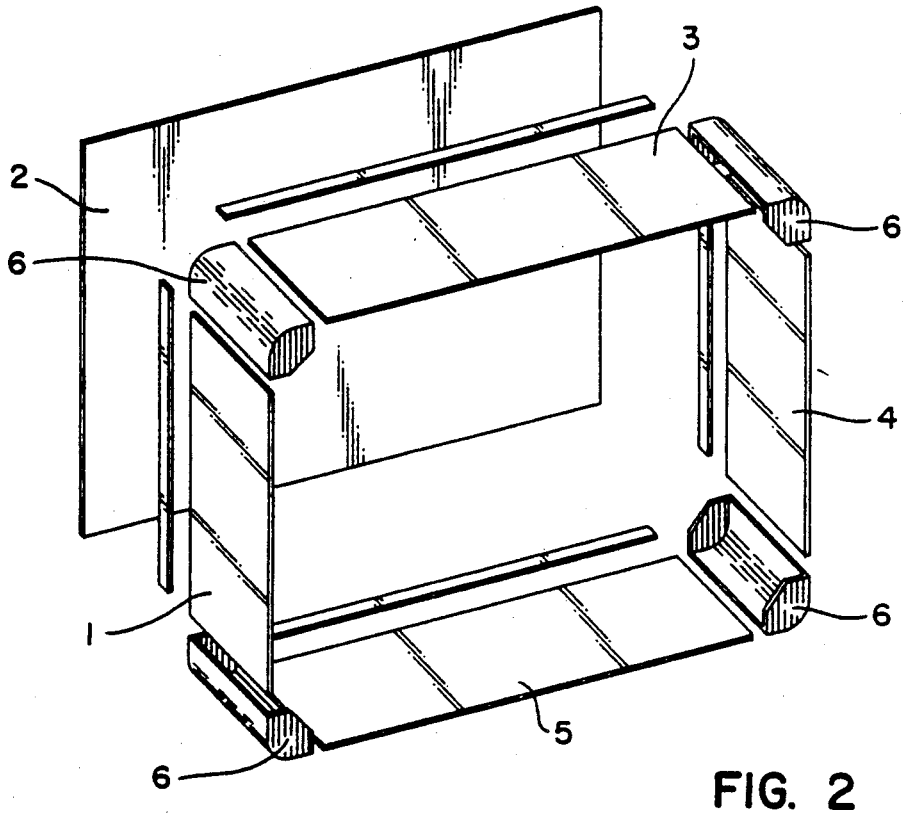
FIG. 2 is a schematic explanatory and exploded view for mounting a suitcase according to the invention.
Figure 4:
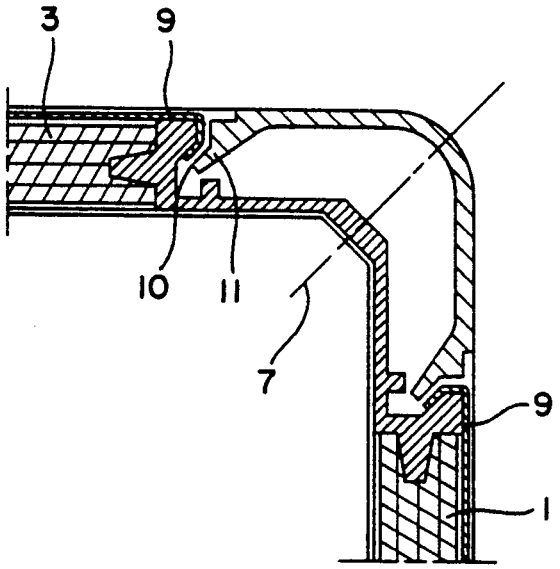
FIG. 4 is a schematic explanatory view of another mounting detail.

As illustrated schematically in FIG. 2, the suitcase according to the invention is realized in the following way:

It comprises for each of its constituent parts (cover and container) a composite belt formed from panels 1 to 5 and intermediary corner pieces called hereinafter "structural corners" 6. Each of such structural corners is realized so that it may be used as connection means between two adjacent panels such as 1 and 3, and the corresponding corner of the "bottom" 2, through fitting in or assembling means of the type including those well known for example in the domain of joinering or cabinet making or in the domain of metals such as assembly through mortise and tenon, assembling through dovetails, assembling of the simple angle straddler type, assembling by grooves, rivets and the like. It is not thought it necessary to represent in detail the realization of such assembling modes or systems, which are well known by the man of the art , since the invention does not reside in such systems themselves, but in the presence of said structrual corners 6 provided with these known means. FIG. 4, however, illustrates a mortise and tenon assembly.

Once the five panels 1 to 5 have been thus assembled to one another, the obtained assembly is consistent and can be directly used on the condition that two assemblies are connected to one another through at least one hinge to thereby constitute a chest or a suitcase. Obviously, the constituent materials of the panels are selected among known resistant materials such as metallic materials, wood, chipboards, hard plastics materials, and the like. However, the so realized chest or suitcase will only present the resistance resulting from the very nature of the selected constitutive materials. The edge portions of angles and the corners are however exposed to impacts, shocks and various deformation stresses and consequently to risks of deterioration when the angular edge portions are not reinforced or protected. This invention precisely contemplates such reinforcing and protection. Moreover, its object is also to use the same reinforcing and/or protective means for positioning and securing a coating material in another manner than through precarious and/or easily torn off means that one might intend to add to, or design for, a chest or a suitcase, either of the conventional type or of a type realized as described above but without those protective and/or reinforcing means which are the object of this invention.

Such means are substantially constituted by corner irons such as those designated by reference numerals L, V, and T. The corner iron such as at T (see FIG. 1) is directly mounted onto the corresponding structural corner 6 to thereby contribute to the reinforcement of the role of such corner acting as a structural and main support while protecting it from shocks. Advantageously, such mounting can be effected by providing complementary systems, for example, of the groove and sliding means type on the corner iron and the corner 6, the final securement occuring for example by screwing (illustrated by dash and dot lines and designated in FIG. 4 by reference numeral 7). As regards the other corner irons such as L and V, these may also be mounted directly onto the corresponding edge portions or also through groove and sliding means systems provided on the edge portions.

Figure 3:
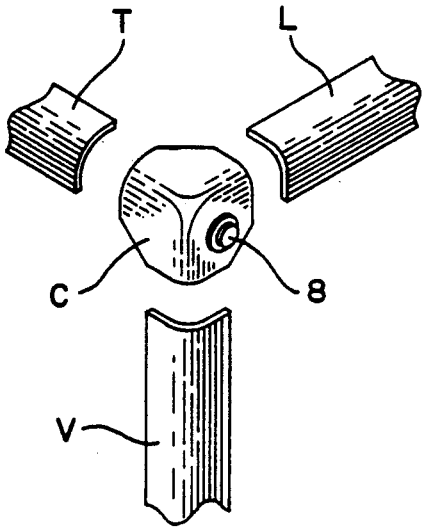
FIG. 3 is a schematic explanatory and exploded view of a mounting detail.

Anyhow, to additionally strengthen the assembly, the three corner irons T, L and V forming a beam are put up together at the summit of the trihedron formed thereby so as to be in their turn made integral at this summit with the corresponding structural element 6 through a part also in form of a corner. This is the part designated by reference numeral C in FIGS. 1 and 3, such part being itself made integral with part 6 for example by means of a screw 8. Moreover, an edge reinforcement W is also provided for reinforcing the edge opposite to the bottom 2 of the assembly, and such corner iron can be mounted in a suitable manner known in itself. This corner is also advantageously made integral with the structural members 6 to contribute to the mechanical strength of the structural assembly.

In accordance with the invention the corner irons mentioned above have such a profile and cooperate with such a profile in the corresponding element protected thereby that they serve for fitting the edges of the layer 9 of the coating element which can be made from tissue, leather, skin and the like. This operation can be realized by means of both corresponding profiles 12–11 (with sliding means) such as those illustrated by way of example in FIG. 4.

Particularly, by way of example as seen in FIG. 4 each corner iron such as T has opposing edges, each of which terminates at an angular flange profile 11. Each angular flange profile 11 cooperates with a corresponding selvedge retaining recess profile 12. As seen in FIG. 4 the angular flange profiles 11 including outer tips 10 on each edge of corner iron T are received in and overlapped by the selvedge retaining recess profiles 12 on side panels 1 and 3, thereby clamping the selvedge of the coating 9 between recess profiles 12 and angular flange profiles 11. In the case of the corner irons along the length (L) and width (V) of the case, angular flange profiles 11 cooperate with corresponding selvedge retaining recess profiles 12 in an adjacent panel (1, 3, 4 or 5) and bottom 2. In the case of the corner irons along the height (T) of the case, as exemplified in FIG. 4, the angular flange profiles 11 cooperate with the corresponding selvedge retaining recess profiles 12 in adjacent panels (1, 3; 3,4; 4, 5 and 1, 5). The man of the art will appreciate the interest of such a mounting.

Thus, the suitcase according to the invention due to its structure is shock and deformation resistant. It can be easily dismounted for any repair; it can also be coated as desired due to the fact that it can be dismounted and in view of the simplicity of the means for holding in position the selected coating material.

Finally, it will be understood that this invention was only described and represented in a purely explanatory and not at all limitative manner and that any useful modification can be made thereto without however departing from its scope as defined in the appended claims.

I claim:

1. A suitcase having a container portion and cover portion, each in the form of a trihedron, in which each portion comprises:

(a) four belt panels and a bottom panel;

(b) structural corner pieces, each structural corner piece attached directly to one edge of two different panels, such that the structural edge pieces and the side and bottom panels form a self-supporting trihedron; and (c) corner irons, each corner iron covering substantially the entire length of an associated structural corner piece, the corner iron being secured directly to the associated structural corner piece and not secured directly to either panel that is attached to said structural corner piece, the corner irons providing a protective cover over the structural corner pieces.

2. A suitcase as in claim 1, wherein the corner irons are removable from the suitcase portion without disassembling the trihedron.

3. A suitcase as in claim 2, wherein the structural corner pieces and the corner irons each have a substantially uniform cross section over their entire length.

4. A suitcase as in claim 3, wherein the cross sections of the corner irons and their associated structural corner pieces present matching contours, so that the corner iron is located precisely on the structural corner piece.

5. A suitcase as in claim 4, wherein the contours of the corner irons and structural corner pieces are such that the corner irons must be removed from the structural corner pieces by sliding the corner irons out from the ends of the structural corner pieces.

6. A suitcase as in claim 5, wherein the ends of each structural corner piece are covered by corner parts removably attached to the structural corner pieces.

7. A suitcase as in claim 2, wherein at least one panel is covered by a covering material, and the edges of the covering material are removably secured between the corner irons and the structural corner pieces.

8. A suitcase as in claim 1, in which each of the structural corner pieces has two ends, and the ends of each structural corner piece are covered by corner parts removably attached to the structural corner pieces.

* * * * *